US005813056A

United States Patent [19]

Ambrose

[11] Patent Number: 5,813,056

[45] Date of Patent: Sep. 29, 1998

[54] HYDRODYNAMIC GOGGLES STRAP

[76] Inventor: Richard W. Ambrose, 15 Vista del Mar, Santa Barbara, Calif. 93109

[21] Appl. No.: 587,678

[22] Filed: Jan. 17, 1996

[51] Int. Cl.[6] ..... A61F 9/02

[52] U.S. Cl. ..... 2/452; 2/428

[58] Field of Search ..... 2/428, 430, 452, 2/209, 423, 2.14; 351/43; 434/254

[56] References Cited

U.S. PATENT DOCUMENTS

| | | | |
|---|---|---|---|
| Re. 16,111 | 7/1925 | Auster et al. . | |
| D. 207,187 | 3/1967 | Gould | D57/1 |
| D. 219,714 | 1/1971 | Crestin-Billet | D57/1 |
| D. 294,710 | 3/1988 | Witzel | D16/123 |
| D. 305,901 | 2/1990 | Witzel | D16/123 |
| D. 330,717 | 11/1992 | Rupert et al. | D16/123 |
| D. 359,301 | 6/1995 | Thomas | D16/312 |
| 859,786 | 7/1907 | Steenerson . | |
| 1,242,684 | 10/1917 | Guinzburg . | |
| 1,274,842 | 8/1918 | Basch . | |
| 1,463,926 | 8/1923 | Schneidt . | |
| 1,483,226 | 2/1924 | Johnson . | |
| 1,546,163 | 7/1925 | Auster et al. . | |
| 1,611,546 | 12/1926 | Milbury . | |
| 1,671,691 | 5/1928 | Anderson . | |
| 1,761,302 | 6/1930 | Howland . | |
| 2,021,144 | 11/1935 | Beck | 132/45 |
| 2,105,956 | 1/1938 | Schnaittacher | 2/68 |
| 2,132,864 | 10/1938 | Suthers | 2/68 |
| 2,162,608 | 6/1939 | Davis | 2/174 |
| 2,215,198 | 9/1940 | Silbert | 128/152 |
| 2,361,963 | 11/1944 | Rosenblatt | 181/22 |
| 2,405,326 | 8/1946 | Plotsky | 2/209 |
| 2,488,235 | 11/1949 | Pfeiffer | 2/14 |
| 2,515,554 | 7/1950 | Freeman | 2/68 |
| 2,581,007 | 1/1952 | Douglas et al. | 128/141 |
| 2,593,892 | 4/1952 | Kindel | 2/174 |
| 2,705,802 | 4/1955 | Tellier | 2/68 |
| 2,738,514 | 3/1956 | Gondell | 2/209 |
| 2,929,071 | 3/1960 | Sterling et al. | 2/68 |
| 3,173,147 | 3/1965 | Gross et al. | 2/14 |
| 3,395,702 | 8/1968 | White | 128/151 |
| 3,454,962 | 7/1969 | Hind | 2/2 |
| 3,728,741 | 4/1973 | Lepor | 2/209 |
| 3,755,819 | 9/1973 | Douglas | 2/14 W |
| 3,979,777 | 9/1976 | Gregg | 2/68 |
| 4,279,039 | 7/1981 | Drew | 2/428 |

(List continued on next page.)

FOREIGN PATENT DOCUMENTS 694748 7/1953 United Kingdom .

OTHER PUBLICATIONS

"Device for Quantiative Measurements of Hydrodynamic Drag on Swimmers," D.P. Sheehan Ph.D., D.M. Laughrin, B.A., University of San Diego, Calif., J.Swimming Research vol. 8 (1992) pp. 30–34).

"Choose the Perfect Pair," Chip Zempel, pp. 34–39, *Fitness Swimmer*, Fall 1995.

"My, Oh, Maillot," *Scorecard*.

Advertisement, p. 15, *Fitness Swimmer*.

Advertisement "Ear Band–It", JACO Ent., Inc.

*Primary Examiner*—C. D. Crowder
*Assistant Examiner*—Larry D. Worrell, Jr.
*Attorney, Agent, or Firm*—Scott B. Allison; Chrisman, Bynum & Johnson

[57] ABSTRACT

A strap or band worn on the swimmer's head that is attached to a pair of swimming goggles includes two ear restrainers, one for each of the swimmer's ears, that restrain and at least partially cover the swimmer's ears and pin the ears tightly against the swimmer's head to reduce the swimmer's hydrodynamic drag. When the strap is stretched or elongated around the swimmer's head during use, the top and bottom edges of the ear restrainers curve inward toward the swimmer's head. The strap reduces the swimmer's hydrodynamic drag by reducing the barrier created by the ears when the ears extend outward from the swimmer's head. In addition, the strap creates a smooth surface over the swimmer's ears so that the water passes more easily and quickly over the ears as the swimmer moves through the water.

26 Claims, 2 Drawing Sheets

U.S. PATENT DOCUMENTS

| | | | |
|---|---|---|---|
| 4,660,229 | 4/1987 | Harris | 2/209 |
| 4,670,911 | 6/1987 | Dunford | 2/209 |
| 4,674,136 | 6/1987 | Ladewig | 2/428 |
| 4,682,374 | 7/1987 | Geiser | 2/209 |
| 4,802,245 | 2/1989 | Miano | 2/209 |
| 5,058,606 | 10/1991 | Malkoff | 128/864 |
| 5,092,667 | 3/1992 | Bagley | 351/156 |
| 5,201,856 | 4/1993 | Edwards | 2/209 |

HYDRODYNAMIC GOGGLES STRAP

BACKGROUND OF THE INVENTION

1. Field of the Invention

This invention relates generally to straps for swimming goggles and, more particularly, to a goggles strap that reduces the hydrodynamic drag of a swimmer wearing goggles as the swimmer is swimming or otherwise moving through water.

2. Description of the Prior Art

The sport of swimming has ancient beginnings and a recorded history dating back for centuries. Furthermore, swimming has a long tradition of use for recreational, cleanliness, and exercise purposes. Competitive swimming is a sport that constantly pushes the limits of human performance. Hydrodynamic drag creates resistance to the swimmer's forward movement through the water, thereby reducing the swimmer's velocity through the water. Therefore, in order to maximize their velocity when racing or otherwise moving through the water, swimmers need to reduce water resistance or hydrodynamic drag as much as possible. The presence of hydrodynamic drag is evident by the fact that swimmers must continuously use arm or leg strokes to maintain or increase their speed, since it is not possible for a swimmer to glide continuously through the water without using arm or leg strokes.

Frictional drag, form drag, and wave drag are the three dominant hydrodynamic drag forces acting on a swimmer as the swimmer moves through the water. Frictional drag is created by the resistance of water moving over and across the surface of the swimmer as the swimmer moves through the water. The swimmer's swimsuit, goggles, body hair, and skin create rough surfaces that increase the swimmer's frictional drag. Frictional drag is related linearly to the swimmer's velocity and increases as the swimmer's velocity increases. Form drag is the result of the movement of an object having a particular shape through a fluid. The magnitude of the form drag for a swimmer depends on the specific geometry of the swimmer, the density of the water in which the swimmer is swimming, and the square of the swimmer's velocity. Form drag can be expressed as:

$$F_f = \tfrac{1}{2} p v^2 AC \qquad (1)$$

where $F_f$ is the drag force opposing the forward movement of the swimmer through the water, p is the density of water, v is the velocity of the swimmer, A is the cross-sectional area of the swimmer in the direction of travel, and C is an empirical constant ($0.5 \leqq C \leqq 2$) that depends on the geometry of the swimmer. Like frictional drag, form drag increases as the swimmer's velocity increases. Wave drag is a result of the surface waves, wakes, and turbulence created by the swimmer. In essence, surface waves carry away energy supplied by the swimmer. Therefore, a portion of the energy created by the swimmer lost in waves and not to propel the swimmer forward, thereby reducing the swimmer's efficiency. Like frictional drag and form drag, wave drag increases as the swimmer's velocity increases.

In order to reduce hydrodynamic drag when racing, competitive swimmers will often shave their heads, arms, legs, and torso to reduce the amount of body hair exposed to the water. In addition, competitive swimmers will often choose swimming gear, such as suits, caps, and goggles, that minimize their hydrodynamic drag. Swim caps, for example, can smooth the surface of a swimmer's head, and some swim caps can also pin the swimmer's ears against the swimmer's head. A swimmer's ears are a cause of hydrodynamic drag, since the ears often extend or protrude outward from the swimmer's head and create a barrier to the flow of water around the swimmer's body as the swimmer moves through the water. In addition, the relatively uneven or rough surface of a swimmer's ears can create turbulence and friction in the water, which also increases the swimmer's hydrodynamic drag.

Many types of swim caps have been developed for competitive swimmers in attempts to reduce the swimmers' hydrodynamic drag. Unfortunately, many prior art swim caps can trap water, which can increase the hydrodynamic drag of the swimmer by outwardly extending creating or extending bulges in the swim cap. Furthermore, the rigors of competitive swimming often involve quick and turbulent turns, which can cause the swim cap to rise up and allow the swimmer's ears to protrude or to dislodge completely from a swimmer's head. It is also common for air pockets to develop between the swim cap and the swimmer's head, which reduces the effectiveness of the swim cap.

Many competitive swimmers use goggles while racing in order to prevent chlorine from entering and irritating their eyes and to improve their visibility. In fact, the combination of goggles and swimming caps are well-known in the art. For example, U.S. Pat. No. 4,279,039 issued to Drew, U.S. Pat. No. 3,755,819 issued to Douglas, and U.S. Pat. No. 2,581,007 issued to Douglas et al. In addition to exhibiting the problems discussed above in relation to standard swim caps, however, the disclosed inventions are complicated to manufacture and assemble.

While straps for swimming goggles that do not include swim caps are also well-known, there is still a need for a better, easy to manufacture, goggle strap that is specifically designed for use by competitive swimmers to stay in place during the rigors of competitve swimming and to reduce the swimmer's hydrodynamic drag.

SUMMARY OF THE INVENTION

Accordingly, it is a general object of the present invention to provide a strap for attachment to swimming goggles or other eyewear.

It is another general object of the present invention to provide a strap that reduces the hydrodynamic drag of a swimmer wearing goggles.

It is still another general object of the present invention to provide a goggles strap that is simple in structure and inexpensive to manufacture, yet which is durable and stays in place during the rigors of competitive swimming.

It is a further general object of the present invention to provide a goggles strap that can be used by people having heads of varying shapes and sizes.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described herein, the goggles strap includes two ends which are attached to goggles and two ear restrainers (one for each ear) for restraining the swimmer's ears and for tightly pinning the ears against the swimmer's head during use. The two ear restrainers are connected by bands, which are positioned around the back of the swimmer's head and neck during use. In other embodiments, the bands can have different lengths and/or the lengths of one or more bands can be adjustable so that the position, tension, and fit of the strap on the swimmer's head can be optimized. In an another embodiment, either or both of the two ear restrainers can include holes or slots so as to improve the swimmer's ability to hear and to prevent water from being trapped by the ear restrainers between the ear restrainers and the swimmer's head or ears.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings.

DETAILED DESCRIPTION OF THE PREFERRED EMBODIMENTS

Figure 1:
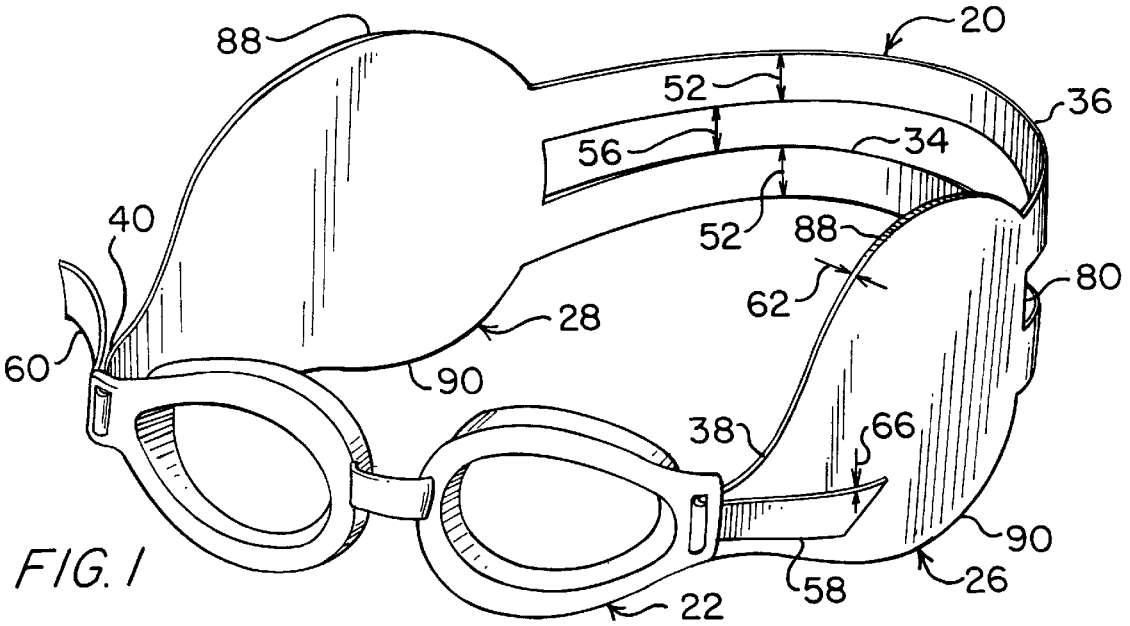
FIG. 1 shows a perspective view of the goggles strap of the present invention.
Figure 2:
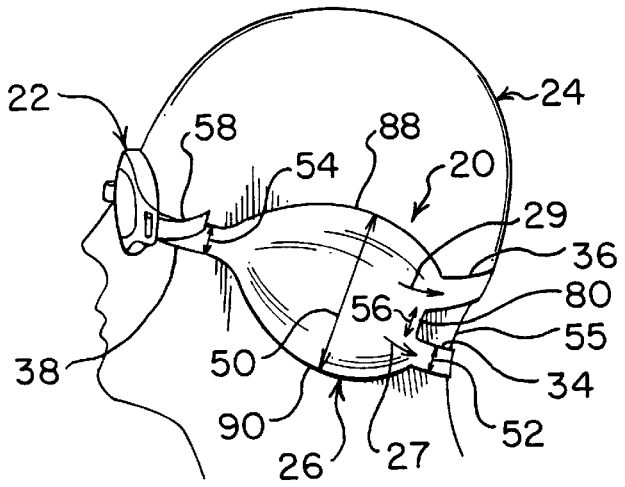
FIG. 2 shows a left side view of a swimmer's head while the swimmer is wearing the goggles strap of FIG. 1.
Figure 4:
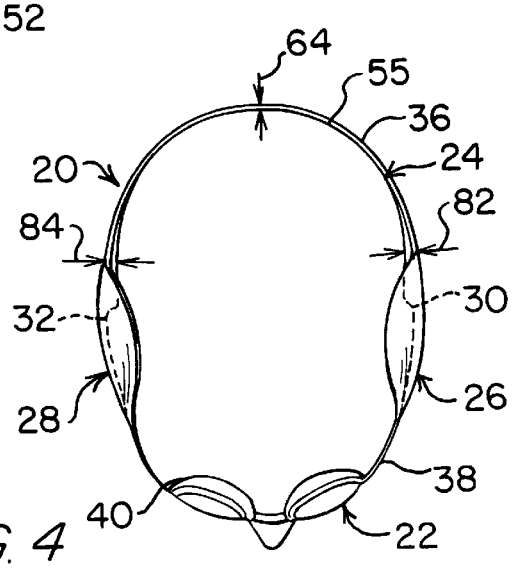
FIG. 4 shows a top plan view of a swimmer's head while the swimmer is wearing the goggles strap of FIG. 1, showing the swimmer's ears in phantom lines under the goggles strap to illustrate how the goggles strap prevents the swimmer's ears from extending or protruding outward from the swimmer's head.

A strap 20 according to the present invention for use in holding swimming goggles 22 on a swimmer's head 24 and for reducing the hydrodynamic drag of a swimmer is illustrated in FIG. 1. As shown in FIGS. 2 and 4, the strap 20 includes the two pliable ear restrainers 26, 28 for partially covering the swimmer's ears 30, 32, respectively, and pinning the swimmers ears 30, 32 against the swimmer's head. The two ear restrainers 26, 28 are preferably substantially flat and thin when the strap 20 is disconnected from the goggles 22 and laid on a flat surface. The strap 20 also includes the two bands 34, 36 for connecting the ear restrainers 26, 28 together and includes two strap extensions 38, 40 for attaching the strap 20 to the swimming goggles 22, as will be discussed in more detail below. The strap 20 can be manufactured as a single or unitary piece of material, or it can comprise separate pieces of material that are glued, bonded, sewn, riveted, or otherwise attached together.

A significant feature of hydrodynamic goggle strap 20 of this invention comprises the two ear restrainers, 26, 28 each of which is configured with a structure that at least partially covers the swimmer's ear 30, 32, respectively, and to pin the ears 30, 32 tightly against the swimmer's head 24. The bands 34, 36 apply forces that create tension in ear restrainers 30, 32, causing ear restrainers 30, 32 to exert radially inward pressure against the ears 30, 32 to force the ears 30, 32 radially inward toward the swimmer's head 24. It is important to note, however, that it is not necessary that the strap 24 and, more specifically, the ear restrainers 26, 28, form a watertight or an airtight seal around the ears 30, 32, as will be discussed in more detail below.

Figure 3:
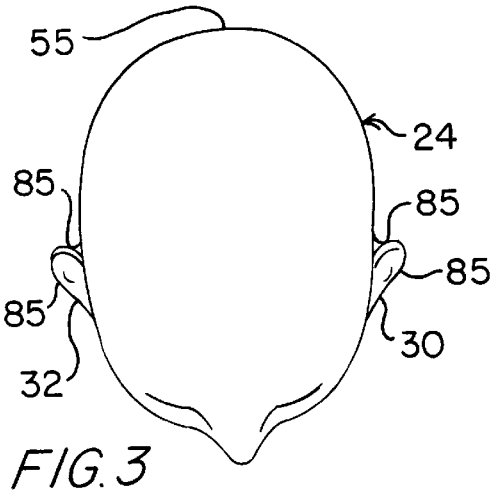
FIG. 3 shows a top plan view of a swimmer's head while the swimmer is not wearing the goggles strap of FIG. 1, illustrating how the swimmer's ears extend or protrude outward from the swimmer's head.

It is quite common for a swimmer's ears 30, 32 to protrude or otherwise extend radially outward from the swimmer's head 24, as shown in FIG. 3. For some people, the extent of outward protrusion of their ears from their heads can be quite profound. The outward protrusion of the swimmer's ears 30, 32 increases the swimmer's hydrodynamic drag by enlarging the swimmer's cross-sectional area in the direction of travel through the water.

A significant advantage of the strap 20 is that it reduces a swimmer's hydrodynamic drag as the swimmer moves through the water. The strap 20 reduces the hydrodynamic drag of the swimmer in two ways. First, by pinning the swimmer's ears 30, 32 against the swimmer's head 24, the strap 20 prevents the ears 30, 32 from protruding outward from the swimmer's head 24 (see FIG. 4), which reduces the swimmer's cross-sectional area in the direction of travel through the water, thereby reducing obstruction to the movement of the swimmer through the water by reducing the swimmer's form drag. Second, the strap 20 provides a smooth cover surface for the swimmer's ears 30, 32 (see FIGS. 2 and 4), which allows water to pass over, by, and around the swimmer's ears 30, 32 more efficiently and reduces the frictional drag and turbulence as the swimmer moves through the water.

Referring again to FIG. 1, the primary components of the strap 20 include the ear restrainers 26, 28 for pinning the swimmers ears 30, 32 against the swimmer's head 24, the bands 34, 36 for connecting the two ear restrainers 26, 28 together, and the strap extensions 38, 40 for connecting the strap 20 to the swimming goggles 22. The strap 20 of the first embodiment of the present invention is preferably, but not necessarily, symmetrical so that the ear restrainers 26, 28 have approximately the same shape and dimensions, the bands 34, 36 have approximately the same shape and dimensions, and the ear extensions 38, 40 have approximately the same shape and dimensions. Since it is possible to optimize the strap 20 for a specific swimmer, however, it is possible for the strap 20 to not be exactly symmetrical. All of these components of the strap 20 will now be discussed in more detail below.

While the ear restrainers 26, 28 are preferably tear-drop shaped, the ear restrainers 26, 28 can also have a triangular shape, an elliptical or oval shape, a circular shape, or other shape variations. The height 50 (see FIGS. 2, 6–8) of the ear restrainers 26, 28 is considerably larger than the height 52 (see FIGS. 1, 6–8) of the bands 34, 34 and the height 54 (see FIGS. 2, 6–8) of the strap extensions 38, 40. For example, the ear restrainers 26, 28 can have a height 50 of approximately three and one-half inches while the bands 34, 36 and the strap extensions 38, 40 can have heights 52, 54, respectively, of approximately one-half inch. While other values can be used for the values of the heights 50, 52, 54, it is preferable that the height 50 of the ear restrainers 26, 28 be at least twice the height 52 of the ear bands 34, 36 or the strap extensions 38, 40. The large height 50 of the ear restrainers 26, 28 relative to the heights 52, 54 of the bands 34, 36 and the strap extensions 38, 40, respectively, allows the bands 34, 36 and the strap extensions 38, 40 to stretch or elongate considerably while preventing the ear restrainers 26, 28 from stretching or elongating significantly when the strap 20 is positioned on the swimmer's head 24. When the ear restrainers 26, 28 are fabricated from a common piece of elastic material, the tensile forces in the bands 34, 36 and strap extensions 38, 40 are resisted by smaller cross-sectional area than those same tensile forces in the larger cross-sectional area of the ear restrainers 26, 28. Therefore, the bands 34, 36 and strap extensions 38, 40 stretch under those tensile forces more than the ear restrainers 26, 28. Reducing the stretch or elongation of the ear restrainers 26, 28 relative to the stretch or elongation of the bands 34, 36 or the strap extensions 38, 40 improves the ability of the strap 20 and the ear restrainers 26, 28 to apply radially inward pressure more uniformly over a larger area on the ears 30, 32 so that the ears 30, 32 are directed toward the swimmer's head 24 and pinned against the swimmer's head 24, thereby reducing the hydrodynamic drag of the swimmer, as previously discussed above.

The height 50 of the ear restrainers 26, 28 can be, but is not required to be, greater than the size of the swimmer's ears 32, 34. Since it is not necessary to create a watertight or an airtight seal around the swimmer's ears 32, 34 in order to reduce the swimmer's hydrodynamic drag, the height 50 of the ear restrainers 34, 36 can be specifically determined for a particular swimmer so that the inward pressure applied against the swimmer's ears 30, 32 by the ear restrainers 26, 28 is optimized and the hydrodynamic drag of the swimmer is minimized. For example, for some swimmers, hydrodynamic drag might be minimized by having the ear restrainers 26, 28 be larger than the swimmer's ears 30, 32 so that the ear restrainers 26, 28 overlap the swimmer's ears 30, 32. For other swimmers, hydrodynamic drag might be minimized by having the ear restrainers 26, 28 be smaller than the swimmer's ears 30, 32. Therefore, invention can be sized accordingly to meet specific swimmer's needs.

Referring again to FIGS. 1 and 2, the two bands 34, 36 connect the two ear restrainers 26, 28 and can, but do not have to, have generally elongated rectangular shapes. The two bands 34, 36, which are approximately parallel when the strap 20 is not being used (as shown in FIGS. 1, 5–7) do not have to be positioned in parallel when the strap 20 is placed on the swimmer's head 24, since the bands 34, 36 can be positioned spread apart more or less from each other on the back 55 of the swimmer's head 24 so that optimal pressure is placed against the swimmer's ears 30, 32 by the strap 20. Spreading the bands 34, 36 apart, for example as illustrated in FIG. 2 and in phantom lines in FIG. 5, may not only increase tensile forces applied by the bands 34, 36 to the ear restrainers 26, 28, but can also orient such tensile forces at different angles and directions in the ear restrainers 26, 28, as illustrated by arrows 27 and 29, to optimize pressure distribution created by those forces on the swimmer's ears 30, 32. The gap 56 between the bands 34, 36 is preferably at least as large as the height 52 of the bands 34, 36 themselves and can be considerably larger depending on the size and shape of the ear restrainers 26, 28. While two bands 34, 36 are preferably used in the strap 20, more bands (not shown) can also be used, if desired, which might increase the ability of the swimmer to optimally position the strap 20 on the swimmer's head 24. In addition, while the two bands 34, 36 extend outward from the ear restrainers 26, 28 in approximately a parallel direction when the strap 20 is not being worn, as shown in FIGS. 1, 5–7, it is also possible for the bands 34, 36 to extend outward from the ear restrainers 26, 28 in a non-parallel manner, as described above, to better accommodate the swimmer's head 24 and to optimize the fit of the strap 20 to the user's head 24.

Figure 5:
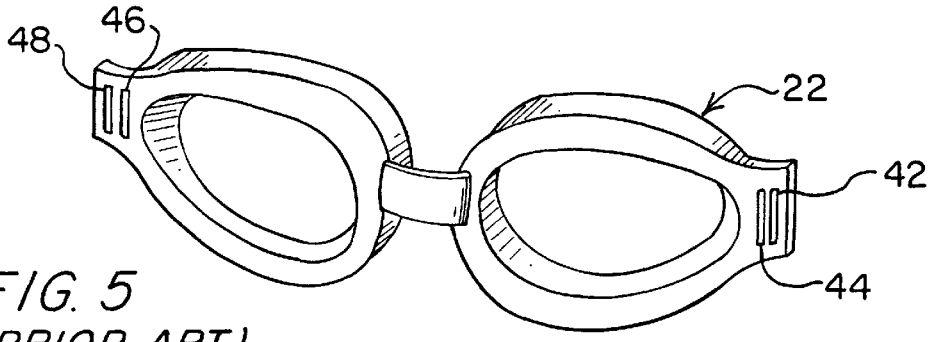
FIG. 5 (PRIOR ART)
FIG. 5 shows a perspective view of a typical pair of goggles that are well-known in the art, but which can be used with the goggles strap of FIG. 1.

Each of the ear restrainers 26, 28 also extend into a strap extension 38, 40. The strap extensions 38, 40 can be attached or otherwise secured to the goggles 22 by gluing, molding, riveting, stapling, or other suitable process, or, alternatively, the strap extensions 38, 40 can threaded through the pairs of goggle slots 42, 44 and 46, 48, respectively (the slots 42, 44, 46, 48 are best shown in FIG. 5). As another example, U.S. Pat. No. 4,279,039 issued to Drew, which is herein incorporated by reference, discloses an attachment of a goggle assembly to a strap assembly that is suitable for use with the goggles strap 20 of this invention. Any excess portion of the strap extensions 38, 40, such as the extension end portions 58, 60, can be cut off the strap 20 or otherwise removed after the strap 20 is attached to the goggles 22 to reduce the effect of the strap extensions 38, 40 on the swimmer's hydrodynamic drag. Alternatively, the extension end portions 58, 60 can be glued, stapled, bonded, or otherwise attached to the strap extensions 38, 40 after the strap is attached to the goggles 22. The use of the swimming goggles 22 and the attachment of strap extensions 38, 40 to the goggles 22 is well-known to persons having ordinary skill in the art and does not need any further discussion for purposes of explaining the structure and operation of the strap 20 of the present invention.

In order to help reduce any hydrodynamic drag created by the strap 20 itself, the strap 20 should be thin. More specifically, the strap 20 preferably has a maximum thickness of approximately 2.0 millimeters. The thickness of the strap 20, however, will depend in part on the material of which the strap 20 is comprised, since the elasticity, stretchability, or elongatability of the bands 34, 36 and the strap extensions 38, 40, as well as the stiffness of the ear restrainers 26, 28, can be different for different types of materials.

It is also possible for the thickness 62 (see FIG. 1) of the ear restrainers 26, 28 to be different than the thickness 64 (see FIG. 4) of the bands 34, 36, or the thickness 66 (see FIG. 1) of the strap extensions 38, 40. More specifically, and by way of example, it may be desirable in certain instances to increase the thickness 62 of the ear restrainers 26, 28 relative to the thickness 64 of the bands 34, 36 and/or the thickness 66 of the strap extensions 38, 40 to increase the stiffness (or reduce the stretchability) of the ear restrainers 26, 28 while maintaining the elasticity, stretchability, or elongatability of the bands 34, 36 and the strap extensions 38, 40. For purposes of explanation, but not limitation, of the structure and operation of the this example of the strap 20 of the present invention, the ear restrainers 26, 28 can have a thickness 62 of approximately 1.5 millimeters while the bands 34, 36 can have a thickness 64 of approximately 1.0 millimeter and the strap extensions 38, 40 can have a thickness 66 of approximately 1.0 millimeter. Alternatively, it may be desirable in other circumstances to decrease the thickness of the ear restrainers 26, 28 relative to the thickness of the bands 34, 36 and/or the strap extensions 38, 40. For purposes of explanation, but not limitation, of the structure and operation of the this example of the strap 20 of the present invention, the ear restrainers 26, 28 can have a thickness 62 of approximately 1.0 millimeter while the bands 34, 36 can have a thickness 64 of approximately 1.5 millimeters and the strap extensions 38, 40 can have a thickness 66 of approximately 1.5 millimeters. It is also possible to have the thickness 64 of one of the bands 34, 36 be different than the thickness 64 of the other band 36, 34 to further allow the swimmer to optimize the strap 20 and the pressure applied against the swimmer's ears 30, 32 by the ear restrainers 26, 28. For example, allowing the band 34 to have a larger thickness 64 than the band 36 allows the band 34 to better accommodate the curvature of the swimmer's head 24 by reducing the stretchability of the band 34. For purposes of explanation, but not limitation, of the structure and operation of the this example of the strap 20 of the present invention, the band 34 can have a thickness 64 of approximately 1.0 millimeter while the band 36 can have a thickness 64 of approximately 0.5 millimeters. Since all three of these examples require that the thickness 62 of the ear restrainers 26, 28 be different from the thickness 64 of the bands 34, 36 and/or the thickness 66 of the strap extensions 38, 40, it may be necessary to create the ear restrainers, 26, 28, the bands 34, 36, and the strap extensions 38, 40 out of separate pieces of material and attach them together by gluing, bonding, sewing, riveting, or other suitable means. Alternatively, the entire strap 20 can be manufactured so that it has a thickness corresponding to the desired thickest part of the strap 20. The thinner parts of the strap 20 can then be created by reducing their thickness by shaving, sanding, pressing, or grinding them down. It may also be possible to create a mold (not shown) for the strap 20 into which the material comprising the strap 20 is injected, poured, or otherwise inserted, wherein the mold (not shown) is designed so that the resulting strap 20 has the desired thicknesses 62, 64, 66 for the ear restrainers 26, 28, the bands 32, 34, and the strap extensions 38, 40, respectively.

The strap 20 can comprise a rubber, neoprene, silicone, polyester, mylar, nylon, polyurethane, synthetic microfibres, composite material, friction-resistive material, or other suitable material so long as the material allows the strap 20 to be elongated for placement on the swimmer's head 24 while maintaining a snug fit around the swimmer's head 24 once the goggles 24 and the strap 20 are positioned. The strap 20 can also be coated with a friction-resistive coating, such as Teflon™ material, to further reduce a swimmer's hydrodynamic drag while the swimmer is moving through the water. During use, the snug fit of the strap 20 on the swimmer's head 24 will prevent the strap 20 from dislodging from the swimmer's head 24.

Figure 6:
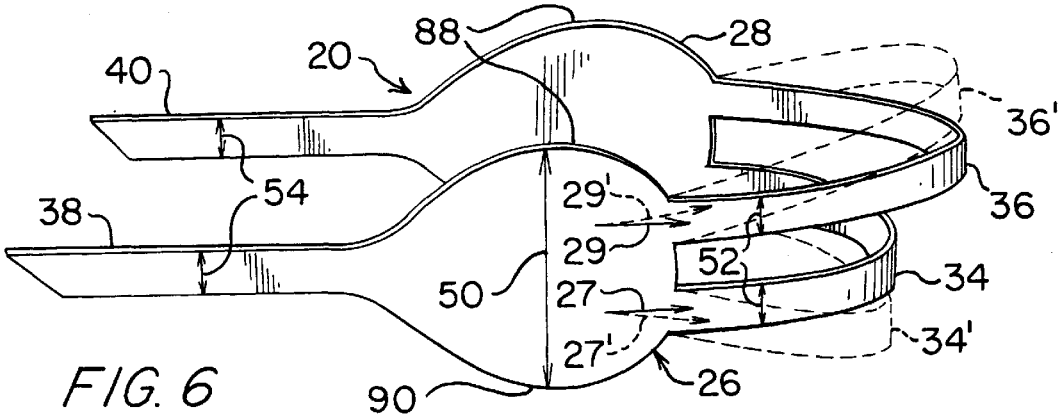
FIG. 6 shows a perspective view of a second embodiment of the goggles strap of this invention wherein both of the two bands connecting the two ear restrainers of the goggles strap have different lengths.

In a second embodiment of the present invention, the band 34 has a longer length than the band 36, as shown in FIG. 6 in order to allow a better and more snug fit of the strap 20 on the swimmer's head 24. Likewise, the band 36 can have a longer length than the band 34. Since both of these examples require that the length of one of the bands 34, 36 is different than the length of the other band, it may be necessary to create the ear restrainers, 26, 28, the bands 34, 36, and the strap extensions 38, 40 out of different pieces of material and attach them together by gluing, bonding, sewing, riveting, or other suitable means. In this embodiment, however, the ear restrainers 26, 28 and their corresponding strap extensions 38, 40 can also each be manufactured as a single or unitary piece of material.

Figure 7:
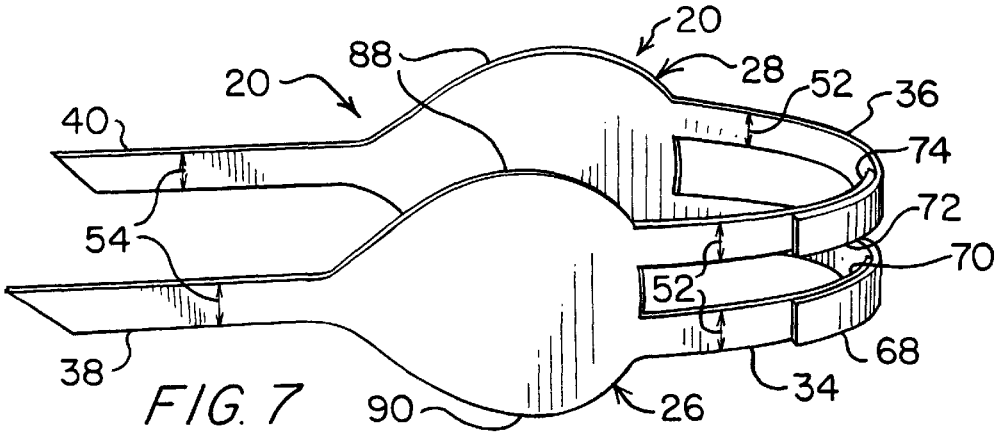
FIG. 7 shows a perspective view of a third embodiment of the goggles strap of this invention, wherein the two bands connecting the two ear restrainers of the goggles strap have adjustable lengths.

In a third embodiment of the present invention, each of the bands 34, 36 comprises two separate pieces 68, 70 and 72, 74, respectively, as shown in FIG. 7. The swimmer can attach the pieces 68, 70 together by Velcro™, snaps, hooks, or other suitable fasteners (not shown) located on the pieces 68, 70, respectively. The pieces 72, 74 for the band 36 can be attached together in a similar fashion. In this embodiment, the length of each of the bands 34, 36 is independently adjustable to allow the swimmer to optimize the length of the bands 34, 36, the tension in the bands 34, 36 and, as a result, the tension in the strap 20 and the inward pressure applied against the ears 30, 32 by the ear restrainers 26, 28, when positioning the strap 20 on the swimmer's head 24. It is also possible to have only one of the bands 34, 36 divided into two pieces.

Figure 8:
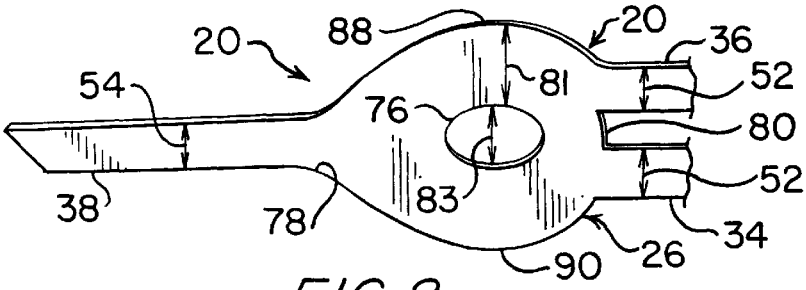
FIG. 8 shows a perspective view of a fourth embodiment of the goggles strap of of this invention, showing a hole in one of the ear restrainers.

In a fourth embodiment of the present invention, the ear restrainers 26, 28 include a slot or hole 76, as shown for the ear restrainer 26 in FIG. 8, in order to increase the swimmer's ability to hear and to prevent any water from being trapped by the ear restrainers 26, 28 between the ear restrainers 26, 28 and the swimmer's head 24. The hole 76 can have a variety of shapes and can be, for example, circular, tear-drop shaped, rectangular, square, or oval. In addition, the hole 76 can be located differently on different straps for different swimmers. For example, it may be desirable to place the hole 76 near the forward edge 78 of the ear restrainer 26 for one swimmer and near the back edge 80 of the ear restrainer 26 for a different swimmer. The hole 76 can also be sized such that the dimension 81 is smaller than the height 83 of the hole 76 and so that the ear restrainer 26 applies pressure to the swimmer's ear 30 only on the radial or outermost portion 85 (see FIG. 3) or perimeter of the swimmer's ear 30. It is also possible to have a plurality of holes or slots (not shown), which may have different shapes, through each of the ear restrainers 26, 28 to accomplish the same objectives of increasing the swimmer's ability to hear and reducing the amount of water potentially trapped between the ear restrainers 26, 28 and the swimmer's head 24. Increasing the swimmer's ability to hear may help the swimmer hear a starting gun or instructions from a coach during competition. In addition, it can be desirable to prevent water from being trapped between the ear restrainers 26, 28 and the swimmer's head 24 since any trapped water may cause the ear restrainers 26, 28 to bulge outward which may increase the swimmer's hydrodynamic drag and which may cause the strap 20 to dislodge from the swimmer's head 24.

During use of the hydrodynamic goggle strap 20, the swimmer places the strap 20 and the goggles 22 on the swimmer's head 24 until they are positioned with the goggles 22 covering the swimmer's eyes and the ear restrainers 26, 28 positioned on the swimmer's ears 30, 32, as shown in FIGS. 2 and 4. The bands 34, 36 extend around the back 55 of the swimmer's head 24 and neck. The ear restrainers 26, 28 are preferably positioned so that they apply pressure radially inward on the swimmer's ears 30, 32, particularly the portions of the ears 30, 32 that extend or protrude the farthest away from the swimmer's head 24, and pin the swimmer's ears 30, 32 tightly against the swimmer's head 24. Depending on the size and shape of the ear restrainers 26, 28 and the size and shape of the swimmer's ears 30, 32, the top edge 88 and the bottom edge 90 of the ear restrainers 26, 28 may curve inward toward the swimmer's head 24 and they may, in fact, come into substantial contact with the swimmer's head.

The swimmer can adjust the positioning of the bands 34, 36 around the back 55 of the swimmer's head 24 and the positioning of the ear restrainers 26, 28 over the swimmer's ears 30, 32 so that the strap 20 and the goggles 22 fit snugly on the swimmer's head 24 and so that the outward extension or protrusion of the swimmer's ears 30, 32 from the swimmer's head 24 is minimized. If possible (depending on which embodiment of the strap 20 is being used), the swimmer can also adjust the distance between the goggles 22 and the ear restrainers 26, 28, and the length of one or both of the bands 34, 36 so that the optimal tension in the strap 20 and the optimal inward pressure against the swimmer's ears 30, 32 is obtained.

Once the strap 20 and the goggles 24 are positioned on the swimmer's head 24, the inward pressure applied by the ear restrainers 26, 28 against the swimmer's ears 30, 32 will flatten, pin, or press the swimmers ears 30, 32 against the swimmer's head 24, which will reduce the swimmer's cross-sectional area in the direction of the swimmer's movement through the water, thereby reducing the swimmers hydrodynamic drag, particularly the swimmer's form drag. In addition, the ear restrainers 26, 30 create a smoother surface for the swimmers ears 30, 32 than would exit without the ear restrainers 26, 28 which further reduces the swimmer's hydrodynamic drag (particularly the swimmer's frictional drag) and, as a result, makes it easier and more efficient for water to flow by, around, and over the swimmer's ears as the swimmer is moving through the water. The efficiency of the water flow over the strap 20 can be increased if the strap 20 is coated with a friction-resistive coating or if the ear restrainers 26, 28 or even the entire strap 20 is manufactured from friction resistive material. The swimmer can adjust the position of the strap 20, particularly the ear restrainers 26, 28, and the tension in the bands 34, 36 or the strap extensions 38, 40 so that an optimal reduction in the swimmer's hydrodynamic drag is obtained or so that a desirable balance is maintained between the swimmer's comfort and the swimmer's reduction in hydrodynamic drag.

As previously discussed above, it is not necessary that the strap 20 create a watertight or an airtight seal around the swimmer's ears 30, 32 in order to obtain a reduction in the swimmer's hydrodynamic drag. In fact, in some circumstances, it may be desirable for a swimmer to intentionally avoid creating a watertight or an airtight seal around the swimmer's ears 30, 32 so that water will not become trapped between the ear restrainers 26, 28 and the swimmer's head 24 as the swimmer is swimming, which might cause the strap 20 to bulge outward, thereby increasing the swimmer's hydrodynamic drag, or dislodge from the swimmer's ears 30, 32. Placement of the strap 20 on the swimmer's head 24 can create gaps 82, 84 between the ear restrainers 26, 28, respectively, and the swimmer's head 24, as shown in FIG. 4. Depending on the positioning of the strap 20 on the swimmer's head 24 and the shape and dimensions of the ear restrainers 26, 28, it is also possible that other gaps (not shown) will exist between the ear restrainers 26, 28 and the swimmer's head 24, particularly at the back edge 80 of the ear restrainers 26, 28 in the gap 56 between the bands 34, 36, and at the top edge 88 and the bottom edge 90 of the ear restrainers 26, 28.

While the strap 20 does not require a watertight or airtight seal around a swimmer's ears 30, 32 in order to provide a reduction in a swimmer's hydrodynamic drag, some swimmer's may, of course, desire to have a watertight or airtight seal around their ears 30, 32, in which case the ear restrainers 26, 28 can be sized accordingly so that a watertight or airtight seal is created. Alternatively, or in addition, the swimmer can also place an ear plug, ear molds, absorptive material, etc. to keep water from entering the swimmer's ear's. Such earplugs, ear molds, and the like, can be made of wax, plastic, rubber, cloth, or other suitable material, and they can be attached to the strap 20 or left unattached to the strap 20. While including such an ear plug, ear mold, or the like may lessen the hydrodynamic benefits created through use of the strap 20, the swimmer will still improve his or her hydrodynamic efficiency by using the strap 20 and will have the additional benefit of a secure placement of the ear plug, ear mold, etc. with the swimmer's ears 30, 32 such that the ear plug, ear mold, etc. will be easily dislodged or displaced as the swimmer is moving through the water.

The foregoing description is considered as illustrative only of the principles of the invention. Furthermore, since numerous modifications and changes will readily occur to those skilled in the art, it is not desired to limit the invention to the exact construction and process shown and described above. Accordingly, all suitable modifications and equivalents may be resorted to falling within the scope of the invention as defined by the claims which follow.

The embodiments of the invention in which an exclusive property or privilege is claimed are defined as follows:

1. A strap for attachment to eyewear and for applying inward pressure against a wearer's ears, comprising a unitary piece of material having a first ear restraining member and a second ear restraining member wherein each of said ear restraining members has a height, a forward edge, and a back edge located distally from said forward edge, a plurality of elongatable bands connecting said back edges of said first and second ear restraining members wherein each of said plurality of bands has a height, a first extension that has a height, is connected to said forward edge of said first ear restraining member, and is connectable to said eyewear, and a second extension that has a height, is connected to said forward edge of said second ear restraining member, and is connectable to said eyewear, further wherein said heights of said first and second ear restraining members are larger than said heights of each of said plurality of bands and said first and second extensions.

2. The strap of claim 1, wherein said heights of said first and second ear restraining members are at least twice the heights of each of said plurality of bands and said first and second extensions.

3. The strap of claim 1, wherein each of said plurality of bands has a length and the length of at least one of said plurality of bands is not equal to the length of another of said plurality of bands.

4. The strap of claim 1, wherein said strap is coated with a friction-resistive coating.

5. A strap for attachment to eyewear and for applying inward pressure against a wearer's ears, comprising a unitary piece of material having first and second ear restraining members that at least partially cover the wearer's ears and apply inward pressure on said wearer's ears when the strap is being worn by the wearer, a plurality of elongatable bands connecting said first and second ear restraining members, wherein each of said plurality of bands has a generally rectangular top surface, a first elongatable extension that is connected to said first ear restraining member distally from said plurality of bands and is connectable to said eyewear, and a second elongatable extension that is connected to said second ear restraining member distally from said plurality of bands and that is connectable to said eyewear.

6. A hydrodynamic drag reducer for a person moving through a fluid, comprising a strap connected to goggles wherein said strap partially encircles said person's head and includes first and second ear restraining members having sizes and shapes to at least partially cover said person's ears and to apply inward pressure on said person's ears, a plurality of elongatable bands connecting said first and second ear restraining members and positionable around the back of said person's head or neck, a first stretchable extension connected to said goggles and connected to said first ear restraining member distally from said plurality of bands, and a second stretchable extension connected to said goggles and connected to said second ear restraining member distally from said plurality of bands.

7. The hydrodynamic drag reducer of claim 6, wherein at least one of said plurality of bands includes a first piece connected to said first ear restraining member and a second piece distinct from said first piece, connected to said second ear restraining member and removably connectable to said first piece.

8. A strap for attachment to eyewear and for applying inward pressure against a wearer's ears, comprising:

a first substantially non-elongatable ear restraining member and a second substantially non-elongatable ear restraining member, wherein said first and second ear restraining members will at least partially cover said wearer's ears when said wearer is wearing said strap;

a plurality of elongatable bands connecting said first and second ear restraining members;

a first stretchable extension that is connected to said to first ear restraining member distally from said plurality of elongatable bands and that is connectable to said eyewear; and a second stretchable extension that is connected to said second ear restraining member distally from said plurality of elongatable bands and that is connectable to said eyewear.

9. A method for reducing the hydrodynamic drag of a person wearing goggles when said person is moving through a fluid, comprising the steps of connecting a strap to said goggles and placing said strap partially around said person's head or neck, wherein said strap includes first and second ear restraining members that at least partially cover said person's ears and apply inward pressure on said person's ears when said strap is being worn by said person, a plurality of elongatable bands connecting said first and second ear restraining members and positioned around the back of said person's head or neck when said strap is being worn by said person, a first stretchable extension connected to said goggles and connected to said first ear restraining member distally from said plurality of bands, and a second stretchable extension connected to said goggles and connected to said second ear restraining member distally from said plurality of bands.

10. A strap for attachment to eyewear and for applying inward pressure against a wearer's ears, comprising a unitary piece of material having a first ear restraining member and a second ear restraining member wherein each of said ear restraining members has a height, a forward edge, and a back edge located distally from said forward edge, at least one elongatable band connecting said back edges of said first and second ear restraining members wherein said elongatable band has a height, a first stretchable extension that has a height, is connected to said forward edge of said first ear restraining member, and is connectable to said eyewear, and a second stretchable extension that has a height, is connected to said forward edge of said second ear restraining member, and is connectable to said eyewear, further wherein said heights of said first and second ear restraining members are larger than said height of said elongatable band and said heights of said first and second stretchable extensions.

11. The strap of claim 10, wherein said heights of said first and second ear restraining members are at least twice the height of said elongatable band and said heights of said first and second stretchable extensions.

12. The strap of claim 10, wherein said strap is coated with a friction-resistive coating.

13. The strap of claim 10, wherein said first and second ear restraining members are substantially non-elongatable.

14. The strap of claim 10, wherein at least one of said ear restraining members includes a hole extending through said ear restraining member.

15. A strap for attachment to eyewear and for applying inward pressure against a wearer's ears, comprising a first ear restraining member and a second ear restraining member wherein each of said ear restraining members has a height, a forward edge, and a back edge located distally from said forward edge, at least one elongatable band connecting said back edges of said first and second ear restraining members wherein each said band has a height, a first stretchable extension that has a height, is connected to said forward edge of said first ear restraining member, and is connectable to said eyewear, and a second stretchable extension that has a height, is connected to said forward edge of said second ear restraining member, and is connectable to said eyewear, further wherein said heights of said first and second ear restraining members are larger than said heights of said band and said heights of said first and second extensions.

16. The strap of claim 15, wherein said strap comprises a single piece of material.

17. The strap of claim 15, wherein said at least one of said ear restraining members includes a hole extending through said ear restraining member.

18. A method for reducing the hydrodynamic drag of a person wearing goggles when said person is moving through a fluid, comprising the steps of connecting a flexible strap to said goggles and placing said flexible strap partially around said person's head or neck, wherein said flexible strap includes first and second ear restraining members that at least partially cover said person's ears and apply inward pressure on said person's ears when said flexible strap is being worn by said person, at least one elongatable band connecting said first and second ear restraining members and positioned around the back of said person's head or neck when said strap is being worn by said person, a first stretchable extension connected to said goggles and connected to said first ear restraining member distally from said band, and a second stretchable extension connected to said goggles and connected to said second ear restraining member distally from said band.

19. The method of claim 18, wherein said flexible strap comprises a single piece of material.

20. The method of claim 18, wherein at least one of said ear restraining members includes a hole extending through said ear restraining member.

21. The strap of claim 1, wherein at least one of said ear restraining members includes a hole extending through said ear restraining member.

22. The strap of claim 5, wherein at least one of said ear restraining members includes a hole extending through said ear restraining member.

23. The strap of claim 6, wherein at least one of said ear restraining members includes a hole extending through said ear restraining member.

24. The strap of claim 8, wherein at least one of said ear restraining members includes a hole extending through said ear restraining member.

25. The strap of claim 1, wherein said first and second extensions are stretchable.

26. The strap of claim 6, wherein said strap comprises a single piece of material.

* * * * *